US011264735B1

(12) United States Patent
Randolph et al.

(10) Patent No.: US 11,264,735 B1
(45) Date of Patent: Mar. 1, 2022

(54) ELECTRICAL TERMINAL FOR TERMINATING A WIDE SIZE RANGE OF MAGNET WIRES

(71) Applicant: TE CONNECTIVITY SERVICES GmBH, Schaffhausen (CH)

(72) Inventors: Kurt Allan Randolph, Etters, PA (US); Brian Keith Weaver, Harrisburg, PA (US); Divya Shukla, Harrisburg, PA (US); David Humphrey, Red Lion, PA (US)

(73) Assignee: TE Connectivity Services GmbH, Schaffhausen (CH)

( * ) Notice: Subject to any disclaimer, the term of this patent is extended or adjusted under 35 U.S.C. 154(b) by 0 days.

(21) Appl. No.: 17/005,895

(22) Filed: Aug. 28, 2020

(51) Int. Cl.
*H01R 4/18* (2006.01)
*H01R 13/11* (2006.01)

(52) U.S. Cl.
CPC ..... *H01R 4/185* (2013.01); *H01R 13/113* (2013.01)

(58) Field of Classification Search
CPC ..... H01R 4/185; H01R 13/113; H01R 13/17; H01R 13/187; H01R 13/2442
USPC ..... 439/862
See application file for complete search history.

(56) References Cited

U.S. PATENT DOCUMENTS 4,423,921 A * 1/1984 Hall ..... H01R 13/115 439/849
4,448,468 A * 5/1984 Coldren ..... H01R 13/20 439/266
5,899,775 A * 5/1999 Davis ..... H01R 13/428 439/748
5,924,900 A * 7/1999 Davis ..... H01R 13/428 439/748
6,039,615 A * 3/2000 Suzuki ..... H01R 13/113 439/849
6,086,433 A * 7/2000 Hils ..... H01R 13/113 439/849
7,306,495 B2 * 12/2007 Hashimoto ..... H01R 4/185 439/877
8,070,536 B2 * 12/2011 Ono ..... H01R 4/185 439/877
8,753,141 B2 * 6/2014 Randolph ..... H01R 4/185 439/398
9,130,284 B2 * 9/2015 Onuma ..... H01R 4/185
9,640,877 B2 * 5/2017 Aoki ..... H01R 4/185
9,774,100 B2 * 9/2017 Shinohara ..... H01R 43/055
9,853,366 B2 * 12/2017 Nickel ..... H01R 4/185
10,027,037 B2 * 7/2018 Didonato ..... H01R 4/48
10,079,440 B1 * 9/2018 Didonato ..... H01R 13/115
10,096,913 B2 * 10/2018 Sato ..... H01R 4/185
10,103,469 B1 * 10/2018 Humphrey ..... H01R 4/489
10,211,558 B1 * 2/2019 Didonato ..... H01R 13/432
(Continued)

*Primary Examiner* — Peter G Leigh
(74) *Attorney, Agent, or Firm* — Saxton & Stump LLC

(57) ABSTRACT

An electrical terminal for terminating magnet wire. The terminal includes a mating portion and a wire barrel positioned in line with the mating portion. The wire barrel has a first asymmetrical termination section and a second asymmetrical termination section, with the first termination section provided in line with the second termination section. The first termination section is positioned closer to the mating portion. The first and second termination sections have first side walls, second side walls and base walls. The first side walls, the second side wall and the base walls have a plurality of serrations.

20 Claims, 4 Drawing Sheets

(56) References Cited

U.S. PATENT DOCUMENTS

| | | | | |
|---|---|---|---|---|
| 10,256,560 | B2 * | 4/2019 | Fertig | H01R 13/113 |
| 10,256,561 | B2 * | 4/2019 | Humphrey | H01R 13/113 |
| 10,476,177 | B2 * | 11/2019 | Okuda | H01R 4/184 |
| 10,505,287 | B2 * | 12/2019 | Sato | H01R 43/048 |
| 10,573,978 | B2 * | 2/2020 | Sato | H01R 4/186 |
| 10,637,163 | B2 * | 4/2020 | Wasilko | H01R 4/22 |
| 10,658,784 | B2 * | 5/2020 | Sato | H01R 13/5216 |
| 10,756,449 | B2 * | 8/2020 | Sato | H01R 4/70 |
| 10,777,911 | B2 * | 9/2020 | Tamura | H01R 4/023 |
| 2002/0022412 | A1 * | 2/2002 | Alonson Merino | H01R 13/113 439/849 |
| 2006/0073743 | A1 * | 4/2006 | Ford | H01R 43/05 439/877 |
| 2013/0052889 | A1 * | 2/2013 | Shen | H01R 13/113 439/890 |
| 2015/0380834 | A1 * | 12/2015 | Seipel | H01R 4/182 439/877 |
| 2016/0006134 | A1 * | 1/2016 | Oh | H01B 1/023 439/878 |
| 2016/0172769 | A1 * | 6/2016 | Kamoshida | H01R 4/62 439/877 |
| 2017/0179614 | A1 * | 6/2017 | Kitagawa | H01R 4/188 |
| 2017/0179619 | A1 * | 6/2017 | Nakata | H01R 13/114 |
| 2017/0324172 | A1 * | 11/2017 | Myer | H01R 4/188 |
| 2018/0069327 | A1 * | 3/2018 | Nakata | H01R 4/62 |
| 2018/0261931 | A1 * | 9/2018 | Iwata | H01R 4/184 |
| 2019/0036237 | A1 * | 1/2019 | Maehori | H01R 4/62 |
| 2019/0280444 | A1 * | 9/2019 | Sato | H01R 4/70 |
| 2019/0288427 | A1 * | 9/2019 | Pan | H01R 4/185 |
| 2019/0288428 | A1 * | 9/2019 | Pan | H01R 13/20 |
| 2020/0266561 | A1 * | 8/2020 | Li | H01R 13/113 |

* cited by examiner

ELECTRICAL TERMINAL FOR TERMINATING A WIDE SIZE RANGE OF MAGNET WIRES

FIELD OF THE INVENTION

The present invention relates generally to an electrical terminal for terminating magnet wires. In particular, the invention relates to aa electrical terminal which can terminate a wide size range of magnet wires.

BACKGROUND OF THE INVENTION

A crimp contact is a type of electrical contact that is deformed (i.e., crimped) to grip the magnet wires that are exposed at a terminating end of an electrical wire. The magnet wires are inserted into a cavity defined by the crimp contact, and the crimp contact is then deformed (e.g., crushed) so that the interior surfaces of the crimp contact compress and securely engage the magnet wires. Crimp contacts may facilitate connecting the magnet wires to other electrical connectors or devices.

Known crimp contacts are sized according to a total circular mil area (CMA) of the magnet wires that the crimp contacts will engage. However, these known crimp contacts are typically only suitable for a limited range of CMA. For instance, one contact configuration may only be suitable for a CMA of between 600-3000, while another contact configuration may only be suitable for a CMA between 3000-7000. The tools used to deform the crimp contacts are typically configured for one type of crimp contact. As such, a manufacturer or individual working with electrical wires of different wire gauges may require a number of different crimp contacts and a number of different crimping tools.

Accordingly, there is a need for crimp contacts that are capable of gripping a greater range of CMAs than known crimp contacts.

SUMMARY OF THE INVENTION

An object it to provide a quick connect terminal which can terminate a wide range of sixes of magnet wires.

An embodiment is directed to an electrical terminal for terminating magnet wire. The terminal includes a mating portion and a wire barrel positioned in line with the mating portion. The wire barrel has a first asymmetrical termination section and a second asymmetrical termination section, with the first termination section provided in line with the second termination section. The first termination section is positioned closer to the mating portion. The first termination section has a first termination first side wall, a first termination section second side wall and a first termination section base, the first termination first side wall. The first termination section first side wall, the first termination second side wall and the first termination section base has a plurality of first termination section serrations. The second termination section has a second termination first side wall, a second termination section second side wall and a second termination section base. The second termination first side wall, the second termination section second side wall and the second termination section base has a plurality of second termination section serrations.

An embodiment is directed to an electrical terminal for terminating magnet wire. The terminal includes a mating portion and a wire barrel positioned in line with the mating portion. The mating portion has a bottom wall with resilient contact arms extending from either side of the bottom wall.

Mating terminal engaging members extend from the resilient contact arms. The wire barrel has a first termination section and a second termination section. The first termination section is provided in line with the second termination section. The first termination section having a first termination section base with a first termination section first side wall and an opposing first termination section second side wall extending from the first termination section base. A height of the first termination section first side wall is greater than the a height of the first termination section second side wall. The second termination section has a second termination section base with a second termination section first side wall and an opposing second termination section second side wall extending from the second termination section base. A height of the second termination section second side wall is greater than the a height of the first termination section second side wall.

Other features and advantages of the present invention will be apparent from the following more detailed description of the illustrative embodiment, taken in conjunction with the accompanying drawings which illustrate, by way of example, the principles of the invention.

DETAILED DESCRIPTION OF THE INVENTION

Figure 1:
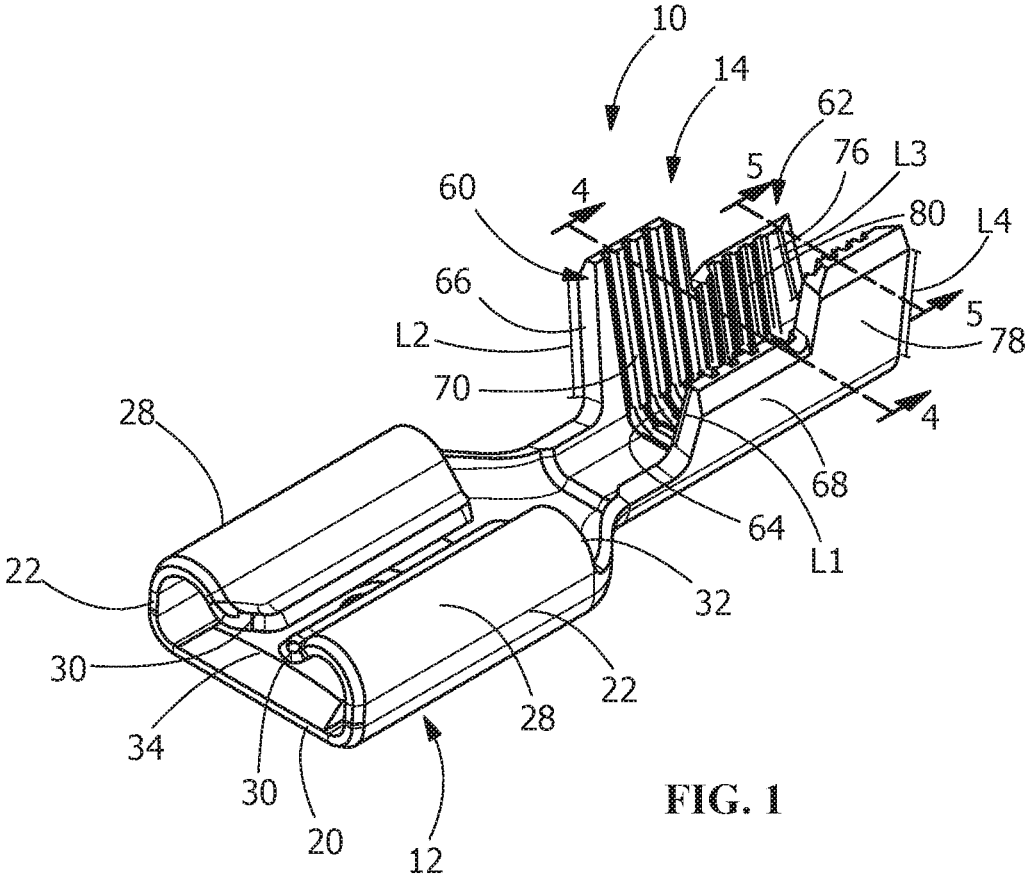
FIG. 1 is a top perspective view of an illustrative terminal of the present invention.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

Figure 2:
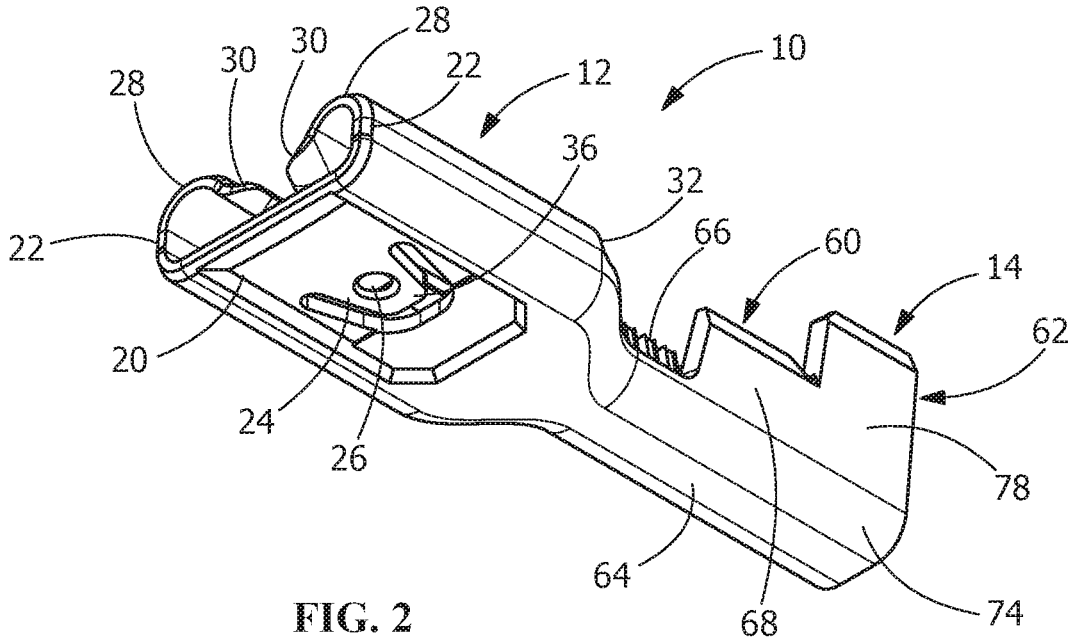
FIG. 2 is a bottom perspective view of the terminal of FIG. 1.
Figure 8:
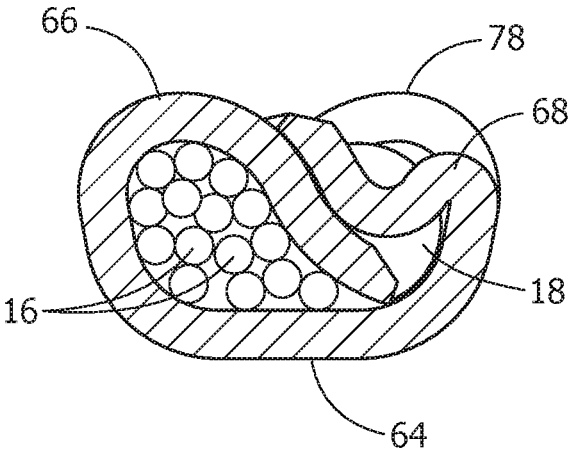
FIG. 8 is a cross-section view of the terminal of FIG. 7, taken along line 8-8.
Figure 9:
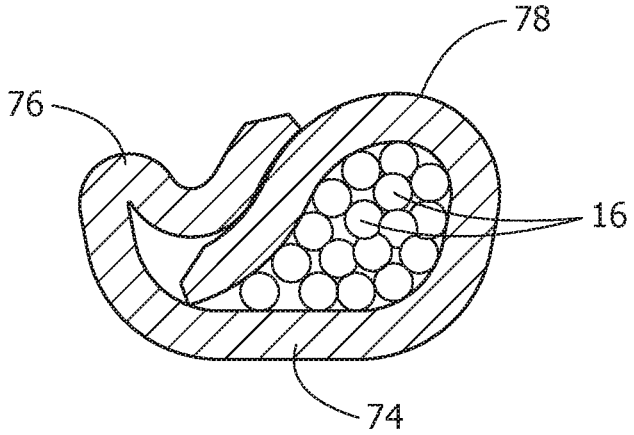
FIG. 9 is a cross-section view of the terminal of FIG. 7, taken along line 9-9.

As shown in FIGS. 1 and 2, a receptacle, socket or female terminal 10 includes a mating portion 12 and a wire barrel 14 positioned in line with and behind the mating portion 12. The wire barrel 14 is configured for crimped connection with ends of insulative conductors 16 of one or more magnet wire 18, as shown in FIGS. 8 and 9. In the illustrative embodiment shown, the terminal 10 is stamped and formed from a metal plate having a good electrical conductivity.

Figure 3:
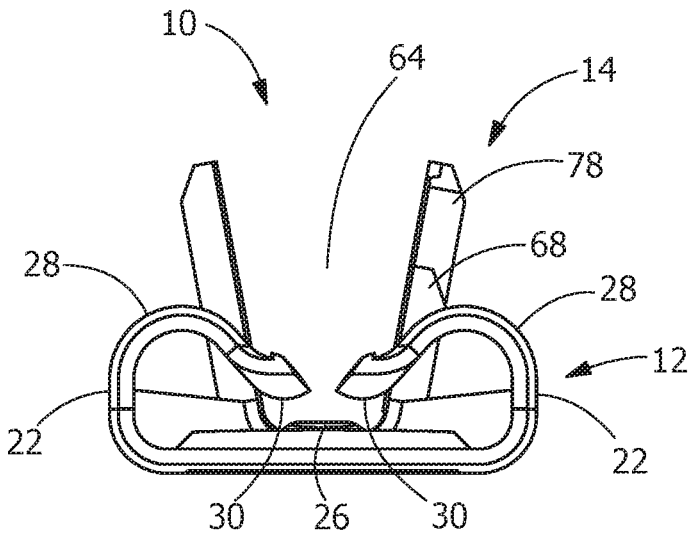
FIG. 3 is a front view of the terminal of FIG. 1.

Referring to FIGS. 1 through 3, am illustrative embodiment of the mating portion 12 includes a bottom wall 20 and resilient contact arms 22 which extend from either side of the bottom wall 20. The bottom wall 20 has a spring arm 24 provided thereon. The spring arm 24 is stamped and formed from the bottom wall 20. While the illustrative embodiment of the mating portion 12 is described, the mating portion 12 may have other configurations, such as, but not limited to, a ring tongue, spade tongue or a magnet wire crimp splice.

The spring arm 24 extends from the bottom wall 20 to create a raised portion or arm extending from the inner surface of the bottom wall 20 toward the resilient arms 22. The spring arm 24 includes a projection or embossment, such as, but not limited to, a projection, detent, dimple or lance 26 (FIGS. 2 and 3) which is formed from the spring arm 24 to create a raised area on an inner surface of the spring arm 24. The lance or projection 26 engages a mating terminal as the mating terminal is inserted into the terminal 10, as will be more fully described below.

The resilient arms 22 have arcuate or curled portions 28 which extend from the bottom wall 20 to a mating terminal engaging member 30. In one illustrative embodiment, the resilient arms 22 may have a tapered configuration, whereby the width of the respective arm 22 proximate the bottom wall 20, is greater than the width of the respective arm 22 proximate the mating terminal engaging member 30. However, other configurations can be used. The configuration the resilient contact arms 22 allows the stiffness and spring rate of the resilient contact arms 22 to be controlled. A wider width of the respective arm 22 proximate the bottom wall 20 allows for a higher spring rate and for a more even distribution of forces from the resilient arms 22 to the bottom wall 20. Conversely, a narrow width of the respective arm 22 proximate the bottom wall 20 allows for a lower the spring rate of the resilient contact arms 22.

In various illustrative embodiments, each of the resilient contact arms 22 has a back surface or edge 32 which extends in a direction which is essentially perpendicular to the longitudinal axis of the terminal 10. This provides a reference surface which can be used when positioning the terminal 10 in a housing or when mating the mating terminal to the terminal 10.

In the embodiment shown, the mating terminal engaging members 30 extend from the resilient contact arms 22 at the top of a terminal mating slot 34. The configuration of the resilient contact arms 22 provide the resiliency needed to allow the mating terminal engaging member 30 to move relative to the bottom wall 20 as the mating terminal is inserted into the slot 34. The mating terminal engaging members 30 may have an arcuate or rounded configuration. However, other configurations of the mating terminal engaging member 30 may be used.

In the illustrative embodiment shown, the spring arm 24 is stamped and formed from the bottom wall 20. The spring arm 24 is formed to allow a free end 36 thereof to move or be resiliently deformed relative to the bottom wall 20, allowing the spring arm 24 to move toward and away from the mating terminal engaging member 30.

In the initial, unstressed position, prior to the insertion of the mating terminal, the spring arm 24 is positioned proximate to, but not in engagement with, the mating terminal engagement members 30. As the mating portion 12 of the terminal 10 must be able to accept and retain mating terminals which are thin, the spring arms 24 must be positioned proximate to the mating terminal engagement members 30.

The configuration of the resilient contact arms 22 and the spring arm 24 allows the mating portion 12 to compensate for any slight misalignment of the mating terminal or any slight warpage or imperfections associated with the mating terminal.

In a fully inserted position, the lance or projection 26 of the spring arm 24 and the mating terminal engagement members 30 are all provided in electrical and mechanical contact with the mating terminal. The multiple areas of contact allow the terminal 10 to be used in applications with higher current levels, such as, but not limited to, 15 to 20 or more amps. The configuration of the spring arm 24 and the mating terminal engagement members 30 provide a stable and reliable electrical connection between the mating terminal and the terminal 10. The configuration of the lance or projection 26 of the spring arm 24 and the mating terminal engaging members 30 provide for higher Hertzian stresses, thereby eliminating or minimizing the fretting corrosion between the terminal 10 and the mating terminal, thereby providing a stable and reliable electrical connection between the mating terminal and the terminal 10.

As portions of the mating terminal engaging members 30 are spaced from and are laterally offset from the lance or projection 26, the connection between the mating terminal and the mating terminal engaging members 30 and the lance or projection 26 of the receptacle terminal 10 are dispersed, i.e. not at one point or in a straight line, providing a stable mechanical and electrical engagement between the mating terminal and receptacle terminal 10 in all environments, thereby insuring that the mating terminal will remain properly positioned in the receptacle terminal 10 as vibration occurs.

As the lance or projection 26 of the spring arm 24 and portions of the mating terminal engaging members 30 are laterally offset from each other, the receptacle terminal 10 provides multiple contact areas even if the mating terminal is bent. In addition, the multiple contact areas resist twisting or misalignment of the mating terminal.

Figure 4:
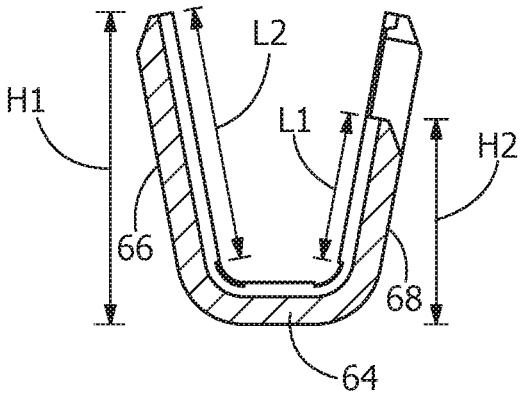
FIG. 4 is a cross-section view of the terminal of FIG. 1, taken along line 4-4.
Figure 5:
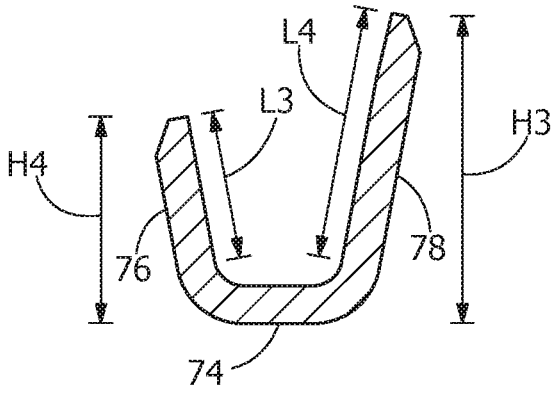
FIG. 5 is a cross-section view of the terminal of FIG. 1, taken along line 5-5.

As shown in FIGS. 1, 4 and 5, the wire barrel 14 has a first termination section 60 and a second termination section 62. In the embodiment shown, the first termination section 60 and the second termination section 62 are provided in line, with the first termination section 60 being positioned closer to the mating portion 12.

The first termination section 60 is asymmetrical and has a base 64 with a first side wall 66 and an opposing second side wall 68 extending from the base 64. The two opposing side walls 66, 68 and the base 64 form a region for holding the wires. In the embodiment shown, the first side wall 66 has height H1 which is greater than the height H2 of the second side wall 68. In an embodiment, the second side wall 68 has a length L1 that is greater than the length L2 of the first side wall 66. In another embodiment, the relationship between L1 and L2 may be reversed.

An inner surface of the region, and each of the side walls 66, 68 and the base 64, have plurality of serrations 70. In embodiment shown, each serration 70 extends from the first side wall 66, across the base 64, to the second side wall 68.

The second termination section 62 is asymmetrical and has a base 74 with a first side wall 76 and an opposing second side wall 78 extending from the base 74. The two opposing side walls 76, 78 and the base 74 form a region for holding the wires. In the embodiment shown, the second side wall 78 has height H3 which is greater than the height H4 of the first side wall 78. In an embodiment, the first side wall 76 has a length L3 that is greater than the length L4 of the second side wall 78. In another embodiment, the relationship between L1 and L2 may be reversed.

The height H1 of the first termination section 60 first side wall 66 is equal to the height H3 of the second termination section 62 second side wall 78. The height H2 of the first termination section 60 second side wall 68 is equal to the height H4 of the second termination section 62 first side wall 76.

An inner surface of the region, and each of the side walls 76, 78 and the base 74, have plurality of serrations 80. In embodiment shown, each serration 80 extends from the first side wall 76, across the base 74, to the second side wall 78.

The serrations 70, 80 are impressions that are created either by removing or displacing material on the inside of the crimp barrel. The serrations 70, 80 serve to provide better contact. High pressure during the crimping deforms the conductors 16 and pushes material it into the serration cavities and as it flows over the edge of serrations 70, 80. As this occurs, the surface of each of the conductors 16 gets scraped and cleaned from oxides or organic films, thus providing a better electrical contact. The serrations 70, 80 contribute to the mechanical stability by bringing clean metallic surfaces together with sufficient pressure that allows "cold welding" to occur. Furthermore, deformation of the conductors 16 into the serrations 70, 80 provides a mechanical "lock", which improves mechanical stability of the crimp. In the embodiment shown, the first termination section 60 and the second termination section 62 of the wire barrel 14 will accept wire sizes and combinations within the range of 300 to 7000 circular mil area (CMA).

Figure 6:
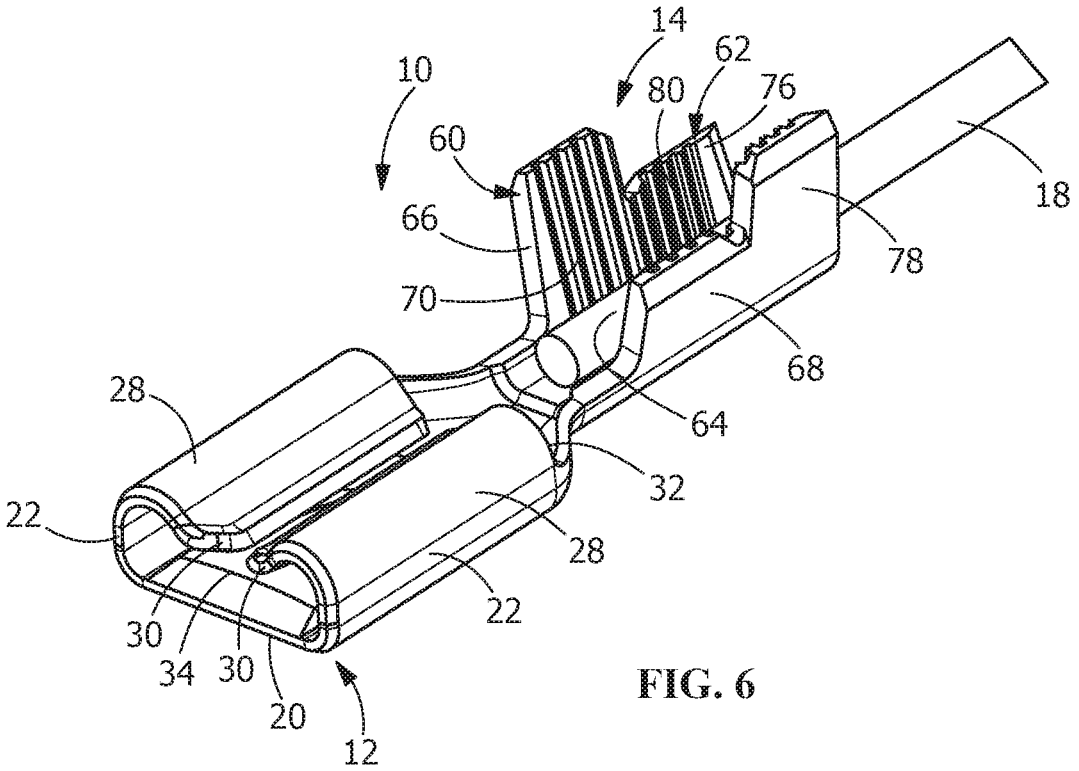
FIG. 6 is a top perspective view of the terminal of FIG. 1 with magnet wires positioned therein.
Figure 7:
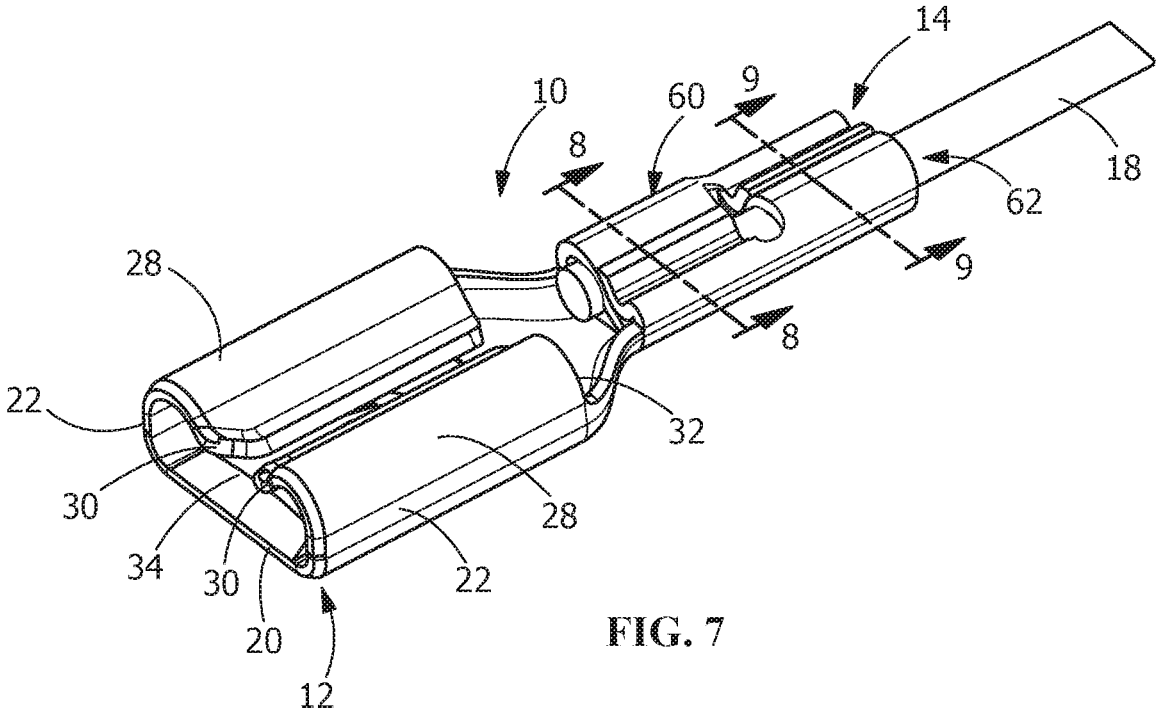
FIG. 7 is a top perspective view showing the wire barrel crimped around the magnet wires.

In use, on or more conductors 16 of the magnet wire 18 is positioned in the first termination section 60 and the second termination section 62 of the wire barrel 14, as shown in FIG. 6. With the magnet wire 18 properly positioned, the first termination section 60 and the second termination section 62 of the wire barrel 14 are crimped, as shown in FIGS. 7 through 9. Crimping is a non-linear process which involves plastic deformation of both the conductors 16 of the magnet wire 18 and the first termination section 60 and the second termination section 62 of the wire barrel 14.

In one illustrative embodiment, when crimped, the first side wall 66 of the first termination section 60 is first deformed to be moved into engagement with the conductor 16 of the magnet wire 18. With the first side wall 66 deformed, the second sidewall 68 is deformed to be moved into engagement with the first side wall 66. Pressure on the second side wall 68 is continued to until the first side wall 66 and the second side wall 68 reach the position shown in FIG. 8. In this position the first termination section 60 is crimped around the conductors 16, and the serrations 70 deform the conductors 16, forming a mechanical and electrical connection between the first termination section 60 of the terminal 10 and the conductors 16 of the magnet wire 18.

Either simultaneously with the crimping of the first termination section 60, after the crimping of the first termination section 60 or before the crimping of the first termination section 60, the second termination section 62 is crimped. When crimped the second side wall 78 of the second termination section 62 is first deformed to be moved into engagement with the conductor 16 of the magnet wire 18. With the second side wall 78 deformed, the first sidewall 76 is deformed to be moved into engagement with the second side wall 78. Pressure on the first side wall 76 is continued to until the second side wall 78 and the first side wall 76 reach the position shown in FIG. 9. In this position the second termination section 62 is crimped around the conductors 16, and the serrations 80 deform the conductors 16, forming a mechanical and electrical connection between the second termination section 62 of the terminal 10 and the conductors 16 of the magnet wire 18.

The use and configuration of the mating portion 12 and the wire barrel 14 provides for a terminal 10 which can effectively terminate a wide range of sizes of magnet wire 18 and which can be quickly connected to a device or mating terminal. The mating portion 12 provides proper retention force and the wire barrel 14 properly terminates copper and/or aluminum magnet wires with the need to strip or remove the insulation prior to termination.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

We claim:

1. An electrical terminal for terminating magnet wire, the terminal comprising:

a mating portion and a wire barrel positioned in line with the mating portion;

the wire barrel having a first asymmetrical termination section and a second asymmetrical termination section, the first termination section provided in line with the second termination section, the first termination section being positioned closer to the mating portion;

the first termination section having a first termination section first side wall, a first termination section second side wall and a first termination section base, the first termination section first side wall, the first termination section second side wall and the first termination section base having a plurality of first termination section serrations, the first termination section first side wall configured to engage conductors of the magnet wire, the first termination section second side wall configured to engage and apply pressure to the first termination section first side wall;

the second termination section having a second termination section first side wall, a second termination section second side wall and a second termination section base, the second termination section first side wall, the second termination section second side wall and the second termination section base having a plurality of second termination section serrations, the second termination section first side wall configured to engage the conductors of the magnet wire, the second termination section second side wall configured to engage and apply pressure to the second termination section first side wall;

wherein the first termination section serrations and the second termination section serrations deform the conductors forming a mechanical and electrical connection between the first termination section, the second termination section and the conductors of the magnet wire.

2. The electrical terminal as recited in claim 1, wherein the mating portion has a bottom wall, resilient contact arms which extend from either side of the bottom wall, mating terminal engaging members which extend from the resilient contact arms.

3. The electrical terminal as recited in claim 2, wherein the bottom wall, the resilient contact arms and the mating terminal engaging members form a terminal mating slot.

4. The electrical terminal as recited in claim 3, wherein the bottom wall has a spring arm provided thereon, the spring arm is stamped and formed from the bottom wall.

5. The electrical terminal as recited in claim 4, wherein the spring arm includes a projection which is formed from the spring arm to create a raised area on an inner surface of the spring arm.

6. The electrical terminal as recited in claim 5, wherein the mating terminal engaging members are laterally offset from the projection.

7. The electrical terminal as recited in claim 2, wherein the resilient contact arms have back edges which extend perpendicular to a longitudinal axis of the terminal to provide a reference surface.

8. The electrical terminal as recited in claim 2, wherein the mating terminal engaging members have a rounded configuration.

9. The electrical terminal as recited in claim 1, wherein the first termination section first side wall and the opposing first termination section second side wall extend from the first termination section base, a height of the first termination section first side wall is greater than the a height of the first termination section second side wall.

10. The electrical terminal as recited in claim 9, wherein each of the first termination section serrations extends from the first termination section first side wall, across the first termination section base, to the first termination section second side wall.

11. The electrical terminal as recited in claim 10, wherein the second termination section first side wall and the opposing second termination section second side wall extend from the second termination section base, a height of the second termination section second side wall is greater than the a height of the first termination section second side wall.

12. The electrical terminal as recited in claim 11, wherein each of the second termination section serrations extends from the second termination section first side wall, across the second termination section base, to the second termination section second side wall.

13. The electrical terminal as recited in claim 12, wherein the height of the first termination section first side wall is equal to the height of the second termination section second side wall.

14. An electrical terminal for terminating magnet wire, the terminal comprising:

a mating portion and a wire barrel positioned in line with the mating portion;

the mating portion having a bottom wall, resilient contact arms extending from either side of the bottom wall, mating terminal engaging members extending from the resilient contact arms;

the wire barrel having a first termination section and a second termination section, the first termination section provided in line with the second termination section;

the first termination section having a first termination section base with a first termination section first side wall and an opposing first termination section second side wall extending from the first termination section base, a height of the first termination section first side wall being greater than the a height of the first termination section second side wall, the first termination section first side wall configured to engage conductors of the magnet wire, the first termination section second side wall configured to engage and apply pressure to the first termination section first side wall;

the second termination section having a second termination section base with a second termination section first side wall and an opposing second termination section second side wall extending from the second termination section base, a height of the second termination section second side wall being greater than the a height of the first termination section second side wall, the second termination section first side wall configured to engage the conductors of the magnet wire, the second termination section second side wall configured to engage and apply pressure to the second termination section first side wall;

wherein the first termination section serrations and the second termination section serrations deform the conductors forming a mechanical and electrical connection between the first termination section, the second termination section and the conductors of the magnet wire.

15. The electrical terminal as recited in claim 14, wherein each of the first termination section first side wall, the first termination section second side wall and the first termination section base, have plurality of first termination section serrations.

16. The electrical terminal as recited in claim 15, wherein each of the second termination section first side wall, the second termination section second side wall and the second termination section base, have plurality of second termination section serrations.

17. The electrical terminal as recited in claim 16, wherein the height of the first termination section first side wall is equal to the height of the second termination section second side wall.

18. The electrical terminal as recited in claim 17, wherein each of the first termination section serrations extends from the first termination section first side wall, across the first termination section base, to the first termination section second side wall, and each of the second termination section serrations extends from the second termination section first side wall, across the second termination section base, to the second termination section second side wall.

19. The electrical terminal as recited in claim 18, wherein the bottom wall of the mating section has a spring arm provided thereon, the spring arm includes a projection which is formed from the spring arm to create a raised area on an inner surface of the spring arm.

20. The electrical terminal as recited in claim 19, wherein the mating terminal engaging members are laterally offset from the projection.

* * * * *